US006213366B1

(12) United States Patent
LaRocco

(10) Patent No.: US 6,213,366 B1
(45) Date of Patent: Apr. 10, 2001

(54) BOX-BELT ATTACHMENT SYSTEM

(76) Inventor: Russell C. LaRocco, 513 Commercial St., Farnham, NY (US) 14061

( * ) Notice: Subject to any disclaimer, the term of this patent is extended or adjusted under 35 U.S.C. 154(b) by 0 days.

(21) Appl. No.: 09/306,556

(22) Filed: May 6, 1999

(51) Int. Cl.[7] ..... A45C 1/04

(52) U.S. Cl. ..... 224/666; 224/268; 224/667; 224/675; 224/964; 229/117.21

(58) Field of Search ..... 229/666, 660, 229/664, 668, 268, 269, 904, 678, 675, 117.19, 117.21, 117.23; 224/248, 258, 259, 42.13, 271, 272, 674, 675, 904, 901.6, 268, 666, 667, 668; 206/806

(56) References Cited

U.S. PATENT DOCUMENTS

| | | | | |
|---|---|---|---|---|
| 1,455,803 | * | 5/1923 | Nofsinger | 224/675 |
| 2,320,067 | * | 5/1943 | Caughren | 224/268 |
| 2,426,484 | * | 8/1947 | Buffenbarger | 224/675 |
| 2,651,441 | * | 9/1953 | Rau et al. | 224/268 |
| 3,332,594 | * | 7/1967 | Capua | 224/675 |
| 3,493,152 | * | 2/1970 | Ort | 224/268 |
| 3,963,156 | * | 6/1976 | Perrin | 224/268 |
| 4,802,602 | * | 2/1989 | Evans et al. | 220/739 |
| 4,936,499 | * | 6/1990 | Gulley | 224/669 |

* cited by examiner

*Primary Examiner*—Stephen K. Cronin
*Assistant Examiner*—Maerena Brevard
(74) *Attorney, Agent, or Firm*—Phillips, Lytle, Hitchcock, Blaine & Huber LLP

(57) ABSTRACT

The invention is directed to an improved box-belt attachment system (15) for attaching a box (16) having a lid (21) to a belt (18). In the preferred embodiment, the attachment comprises a box loop (19) and a belt loop (20), whereby the lid of a box may be folded over the box loop and the belt loop may engage a user's belt. The box loop and belt loop may be formed from a continuous wire member comprised of a flexible elastic material. The elastic material may be spring steel having a substantially circular cross-section. The lid may include two male connections (22) and the back panel (23) of the box may contain two corresponding female connections (24), whereby the lid may be temporarily attached to the back panel of the box. The box may include a reinforced crease (25).

6 Claims, 2 Drawing Sheets

BOX-BELT ATTACHMENT SYSTEM

FIELD OF THE INVENTION

The present invention relates generally to the field of holders and, more particularly, to a novel belt or strap-mounted system for supporting and carrying a box of fasteners, such as nails or screws.

BACKGROUND ART

A variety of devices are known which are used to attach a box or other object to a user's belt. For example, U.S. Pat. No. 5,511,705 discloses a wire holder which may be used to suspend a container from a belt. Similarly, U.S. Pat. No. 5,176,302 discloses a continuous wire device bent to form a belt receiving portion and a handle receiving portion such that the handle of a container may be attached to the user's belt.

However, none of these references disclose an attachment system which may be adapted to attach various sized boxes to a belt, which can be built directly into the structure of the box or sold as a separate item, and which is inexpensive to produce. Hence, it would be useful to provide a box-belt attachment system which could be adapted to attach various sized boxes to a belt and which can be built into the structure of the box or sold as a separate item.

DISCLOSURE OF THE INVENTION

With parenthetical reference to the corresponding parts, portions or surfaces of the disclosed embodiment, merely for the purposes of illustration and not by way of limitation, the present invention provides an improved box-belt attachment system (15) for attaching a box (16) having a lid (21) to a belt (18) comprising a box loop (19) and a belt loop (20), whereby the lid may be folded over the box loop and the belt loop may engage the belt. The box loop and belt loop may be formed from a continuous wire member comprised of a flexible elastic material. The elastic material may be spring steel having a substantially circular cross-section. The lid may include two male connections (22) and the back panel (23) of the box may contain two corresponding female connections (24), whereby the lid may be temporarily attached to the back panel of the box. The box may include a reinforced crease (25).

Accordingly, the general object of the present invention is to provide an improved box-belt attachment system with which a user may attach a box to his or her belt for easy access to the contents of the box.

Another object is to provide an improved attachment adapted to be mounted to the belt of a user.

Another object is to provide an improved attachment adapted to engage a box.

Another object is to provide an improved box-belt attachment system which may be easily incorporated into the structure of the box.

Another object of the invention is to provide an improved box-belt attachment which may be sold separately from the box or belt.

Another object of the invention is to provide an improved box-belt attachment system which may be employed with various sized boxes.

Another object of the invention is to provide an improved box-belt attachment system in which the lid of the box may be folded back and temporarily secured to the back panel of the box.

Another object of the invention is to provide an improved box-belt attachment system in which the crease of the lid of the box is reinforced so that the force of the box hanging by the attachment to the user's belt does not rip the lid from the box.

These and other objects and advantages will become apparent from the foregoing and ongoing written specification, the drawings and the appended claims.

DESCRIPTION OF THE PREFERRED EMBODIMENTS

Figure 1:
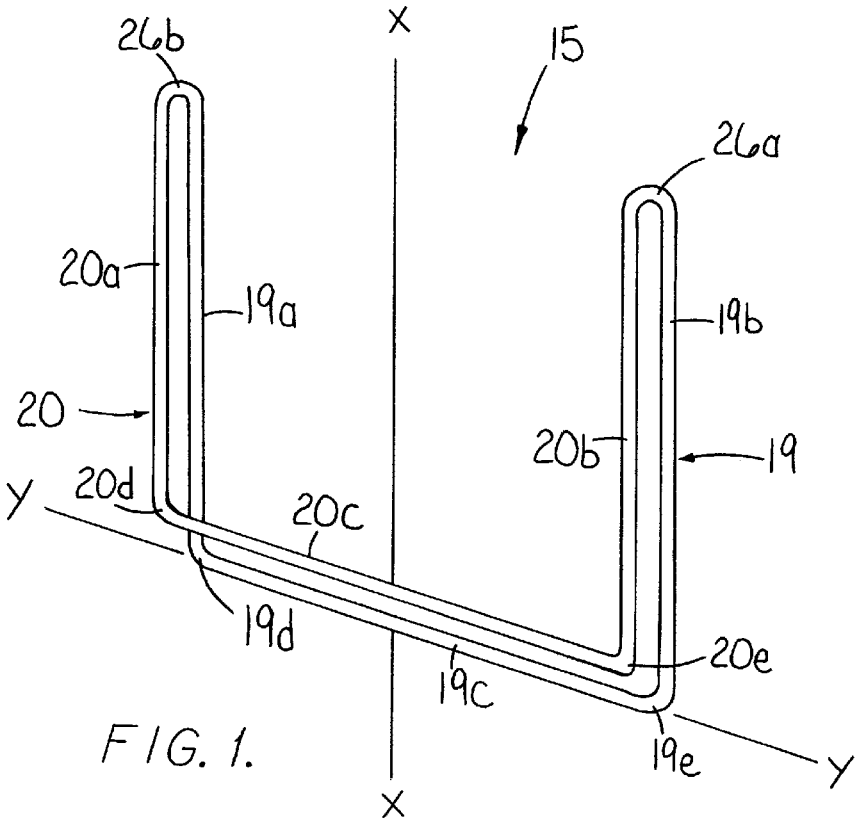
FIG. 1 is a perspective view of the attachment.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, debris, etc.) together with the specification, and are to be considered a portion of the entire written description of this invention. As used in the following description, the terms "horizontal", "vertical", "left", "right", "up" and "down", as well as adjectival and adverbial derivatives thereof, (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to the drawings and, more particularly, to FIG. 1, this invention provides an improved box-belt attachment, of which the presently preferred embodiment is generally indicated at 15. Attachment 15 is shown as broadly including a box loop 19 and a belt loop 20. In the preferred embodiment, attachment 15 is formed from a continuous wire member comprised of a flexible elastic material and having a circular cross-section.

Box loop 19 is comprised of members 19*a*, 19*b*, and 19*c*. Members 19*a* and 19*b* are elongated along axes parallel to axis x—x, and are connected at their bottom ends to transverse member 19*c* by bends 19*d* and 19*e*, respectively. Belt loop 20 is comprised of members 20*a*, 20*b* and 20*c*. Members 20*a* and 20*b* are connected at their bottom ends to transverse member 20*c* by bends 20*d* and 20*e*, respectively. Bends 19*d*, 19*e*, 20*d* and 20*e* form right-angle connections. Member 19*a*, bend 19*d*, member 19*c*, bend 19*e*, and member 19*b* form box loop 19. Member 20*a*, bend 20*d*, member 20*c*, bend 20*e*, and member 20*b*, form belt loop 20. Box loop 19 and belt loop 20 are connected by U-shaped bends 26*a* and 26*b*. Members 20*a*, 20*b* and members 19*a*, 19*b* are elongated along axes parallel to axis x—x. Member 19*c* is elongated along axis y—y. Member 20*c* is equal in length to member 19*c* and is elongated along an axis parallel to y—y. Members 20*a* and 20*b* are the same length. Members 19*a* and 19*b* are the same length. Members 20*a* and 20*b* are shorter in length than members 19*a*, 19*b*.

Figure 2:
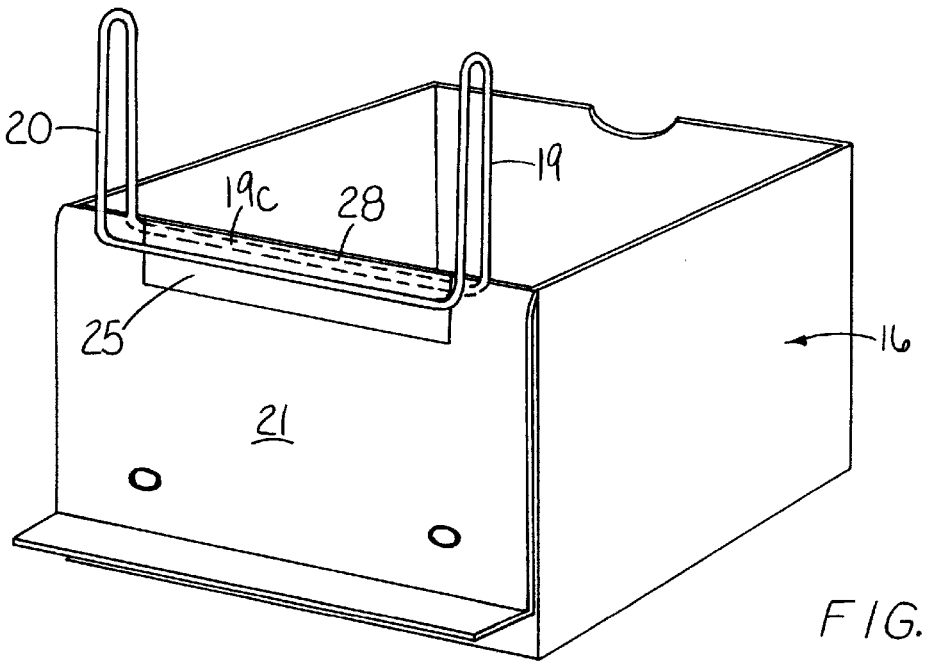
FIG. 2 is a perspective view of the attachment system engaging a box.
Figure 3:
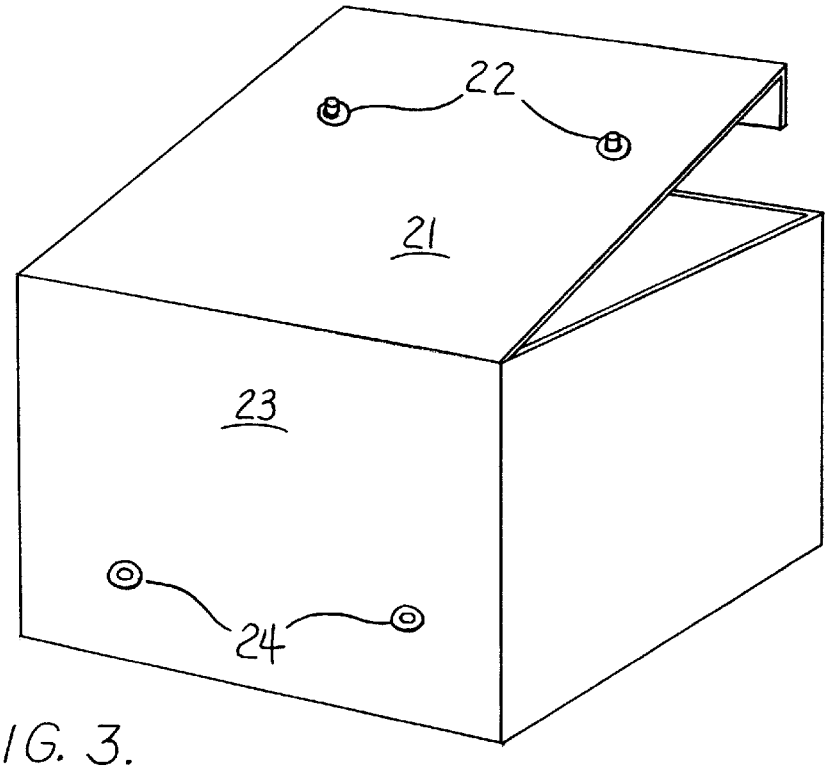
FIG. 3 is a perspective view of the box shown in FIG. 2.
Figure 4:
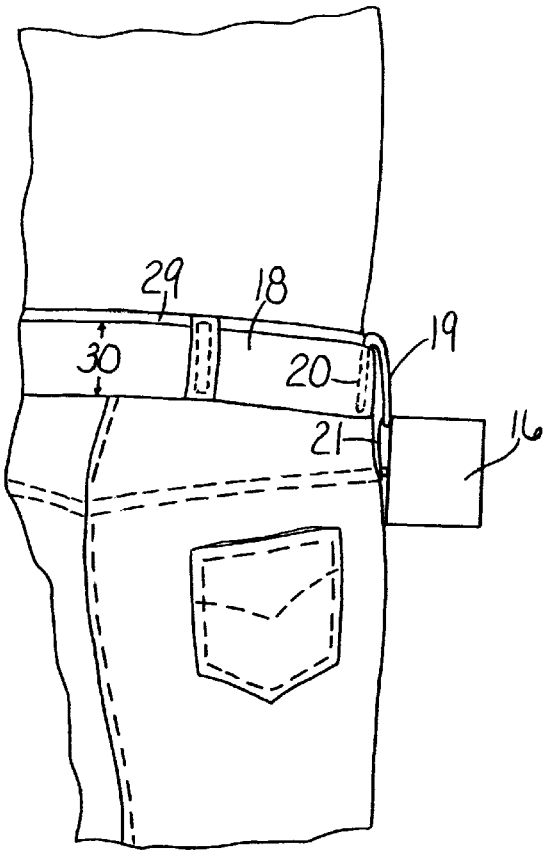
FIG. 4 is a perspective view of the attachment system engaging a user's belt and a box.

As shown in FIG. 2, attachment 15 engages cardboard box 16 at the crease 28 formed between panel 23 of box 16 and lid 21 when lid 21 is open. This engagement is effectuated by opening lid 21 and folding it over member 19*c* and back against panel 23 such that member 19*c* rests up against crease 28. As shown in FIG. 4, lid 21 is held against panel 23 by the weight of box 16 against a user's hip or body. However, as shown in FIG. 3, lid 21 may include standard male connections, severally indicated at 22, which may be connected to corresponding female connections, severally indicated at 24, on panel 23. This snap connection assures that lid 21 is held against panel 23.

As shown in FIG. 2, box 16 may include a reinforced crease 25. Crease 25 can be reinforced with tape or an added layer of cardboard. Reinforced crease 25 adds strength to crease 28 such that the force of box 16 hanging from member 19*c* does not rip lid 21 from panel 23.

As shown in FIG. 4, belt loop 20 slips over and against the inside of a user's belt 18. Members 20*a* and 20*b* of belt loop 20 are positioned on the inside of belt 18. Members 19*a* and 19*b* of box loop 19 are positioned on the outside of belt 18. Thereby, bends 26*a* and 26*b* rest on the top 29 of belt 18 and support the weight of box 16. As shown in FIG. 4, members 20*a* and 20*b* are as long as the width 30 of belt 18. Attachment 15 may be moved along the user's belt to any comfortable or convenient location.

While the attachment may be sold as a separate unit, it may also be sold as part of a box of nails, screws, or other fastening devices. Member 19*c* may be fixably connected along crease 28 such that, when lid 21 is closed, attachment 15 pivots into box 16. In this way, a user of the fastening devices contained in box 16 merely opens lid 21 and positions attachment 15 on his or her belt for easy access to the contents of box 16. After completing the job, the user then folds attachment 15 into box 16 by closing the lid. The user need never transfer fasteners from boxes to a pouch or, when the job is complete or the day ended, transfer his or her unused fasteners back into the appropriate boxes for future use.

MODIFICATIONS

The present invention contemplates that many changes and modifications may be made. The particular materials of which the various body parts and component parts are formed are not deemed critical and may be readily varied. While in the preferred form the attachment is framed from spring steel, it may also be framed from other materials such as plastics.

What is claimed is:

1. A box-belt attachment system for attaching a box having a lid to a user's belt, comprising:

a box having a back panel and a lid, said back panel and said lid being connected at a crease;

a box loop;

a belt loop connected to said box loop, said lid, said box loop and said belt loop being so configured and arranged that said box loop is adapted to have said lid folded over said box loop and said belt loop is adated to engage said belt;

whereby said box is suspended from said belt.

2. The attachment as set forth in claim 1, wherein said box loop and said belt loop are formed from a continuous wire member comprised of a flexible elastic material.

3. The attachment as set forth in claim 2, wherein said elastic material is spring steel having a substantially circular cross-section.

4. The attachment as set forth in claim 1, wherein:

said lid contains two male connections; and said box includes a back panel which contains two female connections, whereby said lid may be attached to said back panel.

5. The attachment as set forth in claim 1, wherein said box includes a reinforced crease.

6. A method of attaching a box to a user's belt, comprising the steps of:

providing a box having a back panel and a lid, said back panel and said lid being connected at a crease;

providing an attachment, said attachment having a box loop and a belt loop connected to said box loop;

folding said lid over said box loop and against said back panel;

positioning said belt loop on the inside of said user's belt;

whereby said box is suspended from said belt by said attachment.

* * * * *